United States Patent [19]

Kuhmonen

[11] 4,186,967

[45] Feb. 5, 1980

[54] ICE REMOVING MACHINE

[76] Inventor: Charles D. Kuhmonen, 5574 Ponderosa, Utica, Mich. 48087

[21] Appl. No.: 931,614

[22] Filed: Aug. 7, 1978

[51] Int. Cl.[2] ..... E01H 5/09

[52] U.S. Cl. ..... 299/25; 37/43 K; 51/177; 299/41; 299/79

[58] Field of Search ..... 299/25, 24, 41, 79; 51/177; 37/43 K, 43 L

[56] References Cited

U.S. PATENT DOCUMENTS

| | | | |
|---|---|---|---|
| 1,647,066 | 10/1927 | Westmar | 299/25 |
| 2,156,066 | 4/1939 | Royer et al. | 299/25 |
| 2,560,443 | 7/1951 | Hosford | 299/41 |
| 3,102,372 | 9/1963 | Vezner | 299/41 |
| 3,496,681 | 2/1970 | Oswald | 299/41 |
| 3,504,434 | 4/1970 | Thomsen | 51/177 X |

*Primary Examiner*—William F. Pate, III
*Attorney, Agent, or Firm*—Krass & Young

[57] ABSTRACT

A machine that mechanically removes ice from surfaces such as driveways, sidewalks and parking lots. The machine includes multiple horizontal rotary discs with depending chippers which strike the ice and pulverize it. The machine is propelled on wheels which maintain a gap between the chippers and the surface being cleaned. The rotary discs are often driven by a motor through a series of pulleys.

3 Claims, 6 Drawing Figures

Fig-3
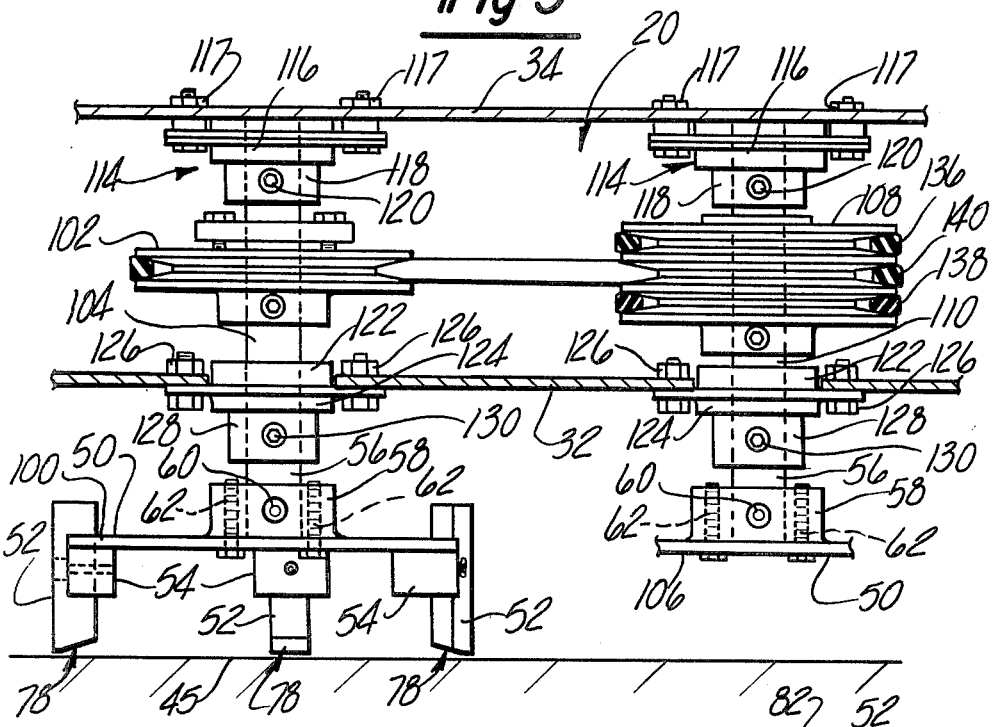
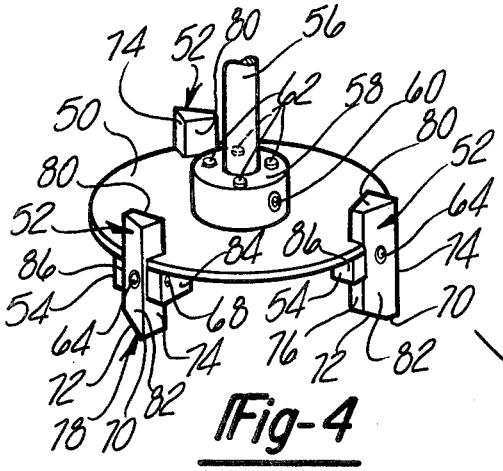
Fig-4
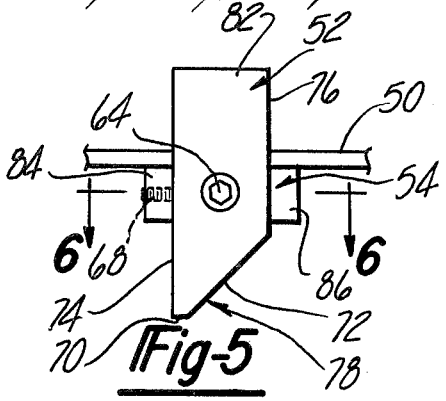
Fig-5
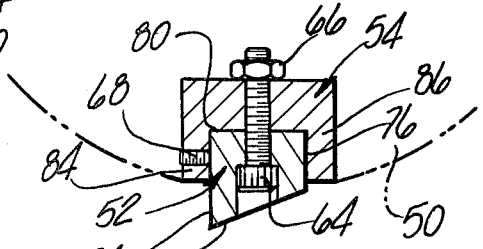
Fig-6

ICE REMOVING MACHINE

BACKGROUND OF THE INVENTION

1. Field of the Invention

This invention relates to a machine for the mechanical removal of ice from surfaces such as driveways, sidewalks and parking lots.

2. Description of Prior Art

In winter snow provides a key element for skiing, tobogganing, sledding and other winter sports. It also provides a hazard for both foot and vehicular traffic. A multitude of devices have been used for the removal of snow, from the lowly shovel and broom to the large plows used for clearing highways. All but the largest and most powerful of these are ineffective for the efficient removal of ice or hard-packed snow.

Heavy vehicular or foot traffic packs the snow and forms ice and concurrently, by its mere presence, prevents the utilization of snow removal means. The daily warming and cooling cycle tends to melt and refreeze the packed snow and to complete the transformation to solid ice.

Manual removal of this ice and packed snow is a tedious and arduous task and becomes impractical when the area to be cleaned is large. Labor costs for large commerical areas such as parking lots are prohibitive.

Chemical removal also has its disadvantages. Ordinary rock salt is ineffective below 10° F. (−12° C.). While calcium chloride works at lower temperatures, the quantities of either rock salt or calcium chloride required to effectively remove any substantial deposit of ice often adversely effects surrounding areas. Heavy use of such chemicals kills grass and other plants. The residues are often tracked indoors and stain the shoes and clothing of those traversing the icy area. Environmentalists have expressed concern in recent years over the monumental quantities of ice removing chemicals which are finding their way into and damaging the environment.

The ideal solution would seem to be a powered mechanical device which can effectively and safely remove the ice. Most prior art devices are designed for snow removal and are totally ineffective at removing ice or hard-packed snow. All but the most powerful snow blowers have about the same effect on ice that they would have on bare pavement.

A number of patents have been granted on devices which appear to be converted lawn mowers. See U.S. Pat. Nos. 2,863,162; 2,983,057; 2,984,919; 3,775,878. All of these devices function primarily as snow blowers. Except for some which have dependent sweeping attachments, it is not necessary that they contact the snow to function. The blades and the appendages thereto create a suction which lifts the snow and blows it in the desired direction.

In the use of these devices for ice removal one finds that the functional parts, usually attached to a rotating blade or disc, must maintain continuous contact with the ice being removed. Because of the length of the arms required to get the blowing action, the portions contacting the ice are too far from the center of moment and require more power than the average lawn mower motor can deliver. If one uses a motor which is powerful enough the high speed attained at the end of the blades which contact the ice create a real danger. A piece of ice or a foreign object embedded in the ice, if hit, will be hurled away from the machine and create a safety hazard for bystanders and the operator. Also with the long center of moment, unless the machine is extremely heavy, it will be impossible to control. The machine has a tendency to turn itself rather than remove the ice.

SUMMARY OF THE INVENTION

I have discovered an efficient and safe means for the mechanical removal of ice. The machine comprises a source of power such as a gasoline engine which rotates a number of rotary discs which are parallel to the surface to be cleaned. The discs have attached to them depending chippers which contact the ice and mechanically remove it. With a plurality of smaller discs, the power required, the force exerted to control movement of the machine, and the danger of flying objects are greatly reduced.

A surprising and advantageous result is obtained when the bottom of the chipper comprises a land portion toward its forward edge and a relief portion. The land portion is substantially parallel to the surface being cleaned and the relief portion is angled away from the surface. This permits cleaning down to bare surface even when there is a gap between the chipper and surface.

In one example, the force required to rotate the rotary discs comes from the motor through a system of pulleys and V-belts. The motor is mounted on a body with the shaft extending into the body. A V-belt pulley on that shaft drives a second shaft which has a three-sheave pulley. The two remaining shafts are driven by V-belts from the second pulley.

BRIEF DESCRIPTION OF THE DRAWINGS

FIG. 3 is a cross-section detail showing drive pulleys and taken along the line 3—3 of FIG. 1;

FIG. 4 is a view of a rotary disc;

FIG. 5 is a view of a chipper;

FIG. 6 is a cross-sectional view of a chipper taken along the line 6—6 of FIG. 5.

DESCRIPTION OF PREFERRED EMBODIMENTS

Figure 1:
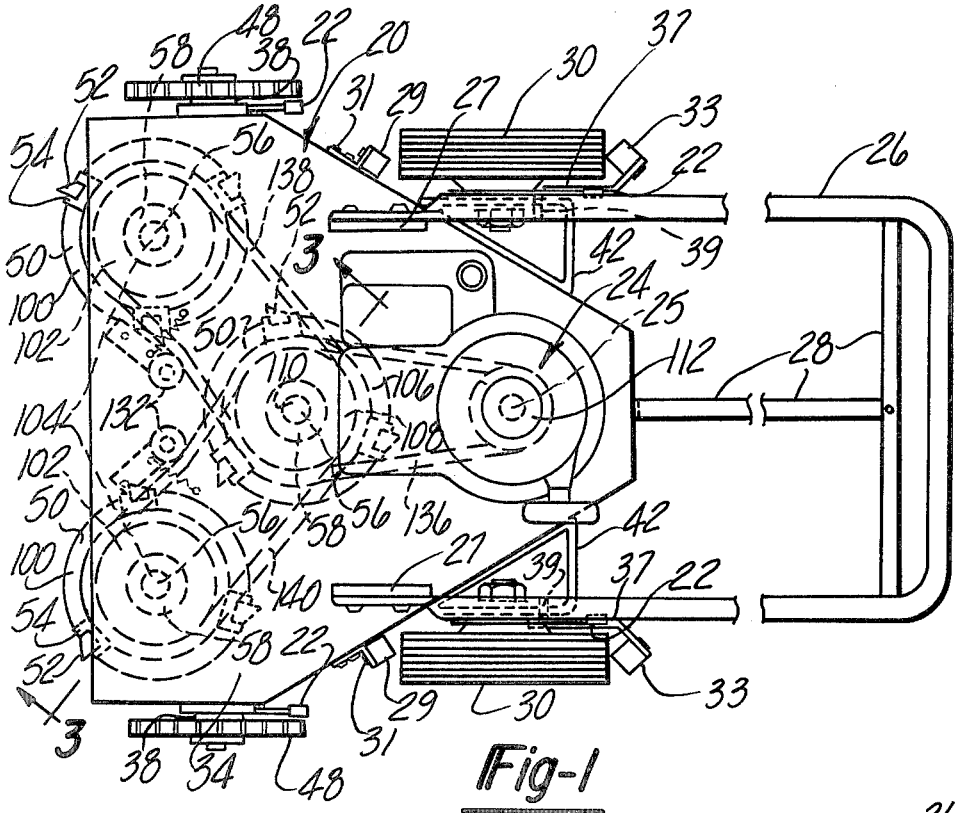
FIG. 1 is a top view of the ice removing machine showing deployment of the rotary discs.
Figure 2:
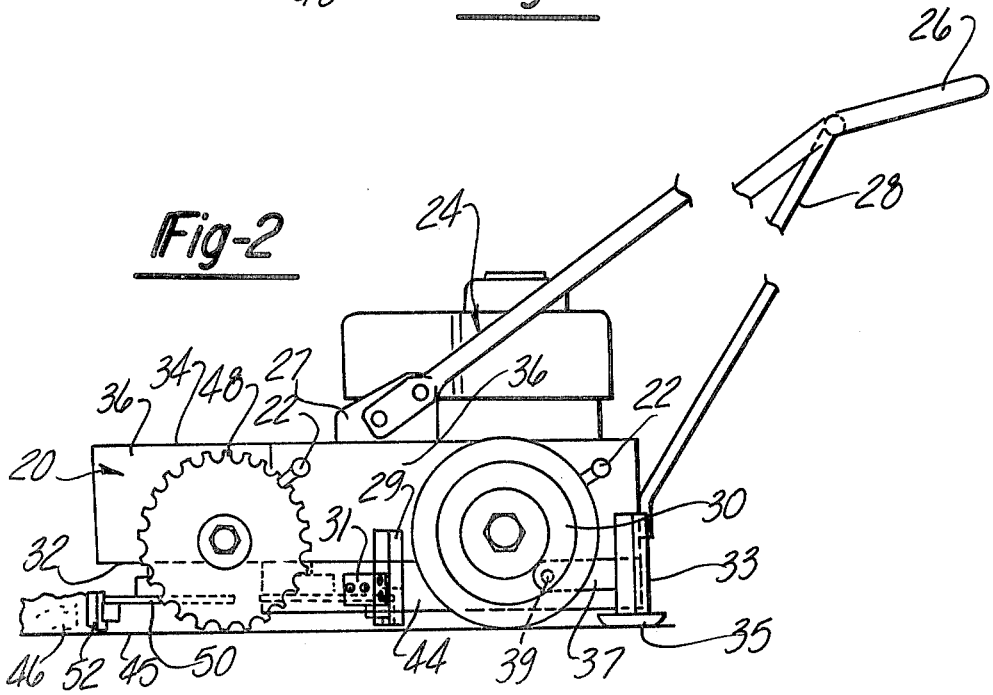
FIG. 2 is a side veiw of the ice removing machine.

The figures as a group show one specific example of this invention. As shown in FIGS. 1 and 2, it has approximately the size and configuration of a conventional lawn mower, but larger or smaller examples would be within the scope of the invention.

1. General Configuration

The machine has a body 20 including a top plate 34, a bottom plate 32 and skirt plates 36 which form the front, sides, and back of the body. The plates in this example are 0.080" thick. There is no substantial internal frame and the major components are attached to the plates and skirts of the body. On the rearward portion of the machine, depending from the skirts is a spray guard 44 which prevents ice chips and any foreign objects picked up by the device from being thrown in the direction of the operator of the machine.

The machine is maneuvered over the surface 45 by an operator who stands to the rear and pushes and steers by means of the handle 26. The handle 26 is attached to the body at the upright connecting flanges 27 which are attached to the top plate 34. The handle 26 receives further support from the T-brace 28 which is attached to the rearward-most skirt plate 36. In this specific example a motor is not used to propel the machine across the surface 45 but such a possibility is within the scope of the invention.

The machine moves over the surface 45 on four wheels. The two front toothed wheels 48 rotate on the front axles 38 which are attached to the side skirt 36. The rear wheels 30 rotate on axles which are attached to rear axle brackets 42 which in turn are attached to the side skirts 36.

The front wheels in the example shown are toothed. The toothed wheel 48 enhances the stability of the machine. As the ice 46 is being removed, the machine tends to move sideways and the toothed wheel prevents this by gripping the surface even through ice and snow. Each of the four wheels has an individual height adjustment. The height adjusters 22 function in the same way as they do on a conventional lawnmower and are well known in the art.

Plows prevent the rear wheels from riding up on loose snow or ice chips formed by the machine. The two forward plows 29 are made of square stock and are rigidly attached to the skirt plates 36 by bracket 31. The rear plows 33 are also square stock but have a shoe 35 at their lower ends. The rear plows 33 are held by the brackets 37 which pivot on the pivot 39. This allows the machine to ride on the rear wheels 36 rather than on the rear plows 33 when the front of the machine is lifted.

The power necessary for removing the ice is supplied by a Briggs and Stratton five horsepower gasoline engine 24. The machine could be powered by another type of engine either electric or one using fuels other than gasoline. The motor has a drive shaft 25 which extends into the body 20 and a drive pulley 112 attached thereto. Through a system of V-belts and pulleys the motor 24 drives three rotary discs 50 which are mounted on shafts 56 which extend into the body through the bottom plate 32. The rotary discs have depending chippers 52 which impinge on the ice 46 and remove it from the surface 45 as shown in FIG. 2.

The deployment of the rotary discs and chippers as shown in FIG. 1 provides distinct advantages over the prior art machines, because the length of the moment arm is shorter. As a chipper contacts the ice, the ice exerts a force back on the chipper equal in magnitude and opposite in direction to the force exerted by the chipper. This reactive force couples with the force driving the disc which acts at the center of the vertical shaft 56. This couple in turn tends to rotate the machine. This rotational force acting on the machine is proportional to the force exerted and the length of the moment arm. For the subject invention this moment arm is relatively short compared to the lawn mower type snow blowing machines where there is only one rotating member. Because of the different positions of rotating discs the force for each couple acts to rotate the machine around a different axis, and thus they partially cancel each other. The use of the plurality of smaller discs or rotating members while clearing a like area, is much easier to control and maintain on a given course.

In the specific example cited all three rotary discs rotate in the same direction. Examples where the rotary discs travel in opposite directions are within the scope of this invention. This could be accomplished by driving one of the forward rotary discs 100 through a gear mechanism rather than by belts. This would further reduce forces tending to pull the machine to one side. The front toothed wheels 48 because of their gripping capabilities, also tend to substantially absorb sidewise thrusts. They require no action by the operator, but react automatically to the forces exerted on them.

2. Drive Train Arrangement.

As shown in FIGS. 1 and 3, the motor 24 is mounted on the top plate 34 and rotates a drive pulley 112 which is mounted on drive shaft 25. The V-belt pulley 112 rotates the intermediate pulley 108 through the drive V-belt 136. The intermediate pulley 108 is attached to the rearward shaft 110 which has a rearward rotary disc 106 depending therefrom The intermediate pulley 108 has three sheaves. It is driven by the drive belt 136 and in turn rotates the two forward shafts 104 through the right V-belt 138 and the left V-belt 140. The V-belts are kept taut by idler wheels 132 which press against the outside surface of the belts.

FIG. 3 shows the configuration of the left forward pulley shaft and rotary disc. The configuration on the right side would be the same as the left side. The forward rotary discs 100 are mounted on the forward shafts 104 which extend into the body 20. The forward rotary shafts 104 are attached to the driven pulleys 102 which are driven by the right and left V-belts 138 and 140.

FIG. 3 shows how the forward shafts 104 and the rearward shaft 110 are mounted onto the body 20. The shafts 56 extend into the bearings 114 at their upper ends. The upper bearing inner races 118 are attached to the top of the shafts by the set screws 120. The upper bearing outer races and flanges 116 are attached to the top plate of the body 34 by the bolts 117. The shafts 56 pass through the lower bearings 122. The shafts 56 are mounted onto the lower bearing inner races 128 by the set screws 130. The lower bearing outer races and flanges 124 are mounted on the bottom plate of the body 32 by the bolts 126.

3. The Rotary Discs.

FIG. 4 shows one of the three rotary discs of this machine. The shaft 56 extends into the body of the machine 20 when it is mounted. In this specific example, the shafts are 1" steel rod. The rotary discs 50 are eight inch diameter, 3/16" thick steel and are mounted to the shafts 56 by collars 58. The collars 58 are attached to the shafts 56 by the pins 60. The rotary disc 50 is attached to the collar by four Allenhead screws 62 which extend up through the bottom of the rotary disc into the collar.

While the rotary discs in this example are circular, this invention clearly encompasses other shapes. The function of the rotary disc is to hold the chippers at a distance from the shaft so that they will move across the surface to be cleaned. The disc could be square, triangular, star-shaped or any other shape which could accomplish this purpose.

Attached to the periphery of the rotary discs 50 are three chippers 52. The chippers are set into the rotary discs and the keyways 54. The keyways 54 are welded to the rotary discs 50. The chippers 52 as seen more clearly in FIG. 6 are fastened to the keyways by Allen screws 64 and lock nuts 66. As the rotary discs rotate, the chippers contact the ice 46 at their lower and outer edges, as can be seen more clearly in FIG. 2 and pulverize it to a fine powder. There is just enough blowing effect from the rotating of the chippers to move the pulverized ice from under the body of the machine. The spray guar 44 prevents any of the pulverized ice from being thrown backwards in the direction of the operator.

FIGS. 5 and 6 give detailed view of a chipper 52 and its attachment to a rotary disc 50. The chipper is attached to the keyway 54 by an Allen screw 64 which passes through the chipper and the keyway and is secured by the lock nut 66. The keyway 54 is welded to the rotary disc 50.

The chipper 52 is a prism of high hardness material. While a specific example is given in this application, the chipper could adopt any one of numerous shapes. Since its function is to strike and pulverize the ice, it must be a high hardness rigid body. It could even be integral with the rotary disc.

In the side view shown in FIG. 5, one sees that in this example the chipper takes the shape of a rectangle with a corner removed at the bottom 78. The chipper moves to the left as shown in FIGS. 5 and 6 so that its front face 74 contacts the ice. The bottom surface 78 of the chipper has a land portion or facet 70 which is normal to the front 74 of the chipper and substantially parallel to the surface 44 over which the machine moves. Immediately behind the land portion 70 is a relief portion 72. This angling off from the horizontal is at 45° and begins $\frac{1}{8}$ of an inch behind the front face of the chipper. This configuration prevents chatter by not allowing contact of the rearward portion of the chipper with solid ice. In the example shown the chipper is three inches from top to bottom and the inside and front faces are $\frac{7}{8}''$ wide.

As seen in FIG. 6, the chipper 52 fits into a rectangular channel in the keyway 54. The keyway embraces the chipper with the forward arm 84 and a rearward arm 86. The set screw 68 passes against the front face 74 of the chipper and prevents any movement in a front to back direction in the keyway. In this view it can be seen that the chipper is a trapezoidal prism with the front face 74 and the back face 76 parallel to each other. The inside face of the chipper is perpendicular to the front and back faces of the chipper but the corner between the outer face 82 and the front face 74 of the chipper is angled at 55°. Again, not allowing contact of the rearward portion of the chipper with the solid ice surface, prevents chatter.

This configuration of a chipper yields an unexpected and advantageous result. When the gap between the bottom of the chipper 78 and the surface 45 to be cleaned is adjusted properly, the chipper will clean completely down to the surface without the requirement of contacting the surface. The ideal gap is between $\frac{1}{4}''$ and $\frac{5}{8}''$. Ideally, the gap should be adjusted toward the higher end of this range in order to minimize contact with any irregularities in the surface being cleaned. The gap is set by adjusting the height adjusters at the four wheels.

The specific machine described herein has been used for clearing ice with good results. It removes ice 5" in depth down to bare pavement at approximately ten square feet per minute. There is no ice film left on the pavement. The only extra effort involved was to sweep away some of the powdered ice which had been left behind.

While we have shown and described several embodiments in accordance with the present invention, it is obvious that the same is not limited to, but is susceptible to numerous changes and modifications as known to those skilled in the art, and we therefore, do not wich to be limited to the details shown and described herein but intend to cover all such changes and modifications as are encompassed by the scope of the appended claims.

The embodiment of the invention in which an exclusive property or privilege is claimed are defined as follows:

1. A machine for removing ice from a surface comprising, in combination,
   - a body maneuverable over a said surface;
   - means for supporting the body above said surface;
   - a plurality of cutting heads depending from the body into proximity to the surface, the cutting heads being mounted on the body for rotation about substantially vertical laterally spaced axes;
   - power means on the body; and
   - power transmission means coupling the power means to the several cutting heads for concurrent rotation thereof;
   - each said cutting head comprising a disc and a plurality of chippers fixed to and depending from the disc, each chipper comprising:
   - a prism of high hardness material with a front, a back and a bottom;
   - said front being a portion of said prism facing the direction of travel of the chipper;
   - said back being a portion of said prism facing opposite said front;
   - said bottom being a portion of said prism furthest from said body and closest to said surface, said bottom comprising a land portion adjacent to the front with a facet substantially parallel to said surface and a relief portion with a facet at an angle from said surface and receding from said surface as it approaches the back of the prism;
   - each chipper having a beveled radially outer surface providing cutting clearance at the outer edge of the chipper;

2. An ice removing machine as described in claim 1 in which the means for supporting the body above said surface includes at least one rotatably mounted toothed idler wheel engaging the surace to resist slipping of the machine on the surface transversely to the wheel.

3. An ice removing machine as described in claim 1 including also plow means mounted on the body adjacent supporting means for the body disposed to scrape ice broken by the chippers from the path of movement of the supporting means over the surface.

* * * * *